US005863196A

United States Patent [19]

Rockwell et al.

[11] Patent Number: 5,863,196

[45] Date of Patent: Jan. 26, 1999

[54] FRAY-RESISTANT WICK AND METHOD OF MANUFACTURING SAME

[75] Inventors: Charles Rockwell, Boonsboro; Amir Yaraghi, Hagerstown, both of Md.

[73] Assignee: FIL-TEC, Hagerstown, Md.

[21] Appl. No.: 708,043

[22] Filed: Aug. 30, 1996

[51] Int. Cl.[6] ..... F23D 3/18

[52] U.S. Cl. ..... 431/325; 431/295; 428/374; 428/296; 428/373

[58] Field of Search ..... 431/325, 298, 431/288; 428/374, 373, 377, 296

[56] References Cited

U.S. PATENT DOCUMENTS

| | | | |
|---|---|---|---|
| 652,548 | 6/1900 | Neustadter . | |
| 2,504,584 | 4/1950 | Ramos . | |
| 2,558,855 | 7/1951 | Knewstubb et al. . | |
| 2,829,511 | 4/1958 | Oesterle et al. . | |
| 3,462,235 | 8/1969 | Summers . | |
| 3,888,620 | 6/1975 | Devon . | |
| 4,211,819 | 7/1980 | Kunimune et al. | 428/374 |
| 4,275,117 | 6/1981 | Crandall . | |
| 4,547,426 | 10/1985 | Montle | 428/377 |
| 4,741,873 | 5/1988 | Fischer et al. . | |
| 4,921,756 | 5/1990 | Tolbert et al. | 428/373 |
| 5,001,961 | 3/1991 | Spain . | |
| 5,032,199 | 7/1991 | Landry et al. . | |
| 5,124,200 | 6/1992 | Mallonee . | |

FOREIGN PATENT DOCUMENTS

| | | |
|---|---|---|
| 54-1936 | 1/1979 | Japan . |
| 57-2906 | 1/1982 | Japan . |

*Primary Examiner*—Larry Jones
*Attorney, Agent, or Firm*—Finnegan, Henderson, Farabow, Garrett & Dunner, L.L.P.

[57] ABSTRACT

The invention comprises a fray-resistant wick made up of an elongated fiber core with a web surrounding the core, and a jacket surrounding the web. The web has a lower melting point than both the core and the jacket, with the web and jacket fusibly or adhesively bonded to the core to form an integral structure. The core or jacket may comprise a fiber glass yarn, and the web a thermoplastic resin such as polypropylene. The method of making the fray-resistant wick comprises forming an enlongated core of the fiber material and surrounding the core with the web, and then surrounding the web with the jacket. Heating the core, web and jacket to a sufficiently high temperature fuses the core and jacket to the web, thereby forming an integral wick structure. In an alternative embodiment, the method comprises surrounding the core with a web of adhesive material for the purpose of bonding the core and jacket.

30 Claims, 4 Drawing Sheets

FRAY-RESISTANT WICK AND METHOD OF MANUFACTURING SAME

BACKGROUND OF THE INVENTION

1. Field of the Invention

The present invention relates to wicks. More particularly, the present invention relates to wicks resistant to fraying. While the invention is subject to a wide range of applications, it is especially suited for use in liquid fuel appliances; and will be particularly described in that connection.

2. Description of the Related Art

Wicks are absorbent material adapted for liquid transfer applications. Although often used to transfer liquid fuel to a point of combustion, wicks may also be used for transfer of ink and lubrication, air freshener and perfume delivery, and gas and liquid filtering applications.

Traditionally, wicks have been manufactured as long strands of absorbent material. During manufacturing, these strands are cut into usable lengths. Not only may the process of cutting the wick strand fray the wick as cut, but it also exposes the wick to additional fraying during use.

To reduce this fraying, mechanical means for binding the ends of the wick have been used. For example, metal wire has been wrapped around the end portion of the wick to prevent fraying or the ends have been bound by tying a knot in the wick to prevent fraying beyond a predetermined point.

The mechanical means for reducing fraying of wicks have many disadvantages. The mechanical means involve an added step in the wick manufacturing process, which adds to the costs of the product. Furthermore, during use, a wick is often inserted into an opening that is of the same inner diameter as the outer diameter of the wick. Mechanically fastening a wick end to prevent fraying can add to the overall dimension of the wick or distort the shape of the wick. Either way, such change in shape can make it more difficult to insert the wick into the device in which it is used. This difficulty can increase the cost of manufacture for the device in which the wick is used, and may increase the cost of maintenance for such a device, by increasing the labor necessary to position the wick.

Mechanical means for reducing fraying have another disadvantage. Mechanical means, such as wire or knots can restrict or prohibit fluid flow along the wick beyond a certain point on the wick.

Non-mechanical means for reducing fraying are also disclosed in the prior art. For example, an absorbent inner core wick may be surrounded by a nonabsorbent nonporous plastic wrap. The plastic wrap is intended to reduce the fraying of the absorbent inner core. This wick construction, however, has certain disadvantages. In particular, because of the outer plastic wrap, such a wick is not absorbent along the outer periphery of its length. Absorption is limited only to the cross-sectional area of the end of the wick. This, of course, reduces the effectiveness of the wick itself.

In another non-mechanical means, the outer portion of a wick core material is heat-fused to an open mesh braid of textile strand material surrounding the core. The braid binds the wick and helps to reduce fraying while the open portions of the mesh element allows for some absorption along the outer wall of the wick. Accordingly, there is some improvement in absorption by the wick as compared to the prior art of a complete plastic wrap. There is, however, still restriction along the mesh portion of the outer walls of the wick.

In light of the foregoing, there is a need for a wick, and method of making such a wick, that will reduce the fraying of the wick by nonmechanical means while maximizing absorption of the wick.

SUMMARY OF THE INVENTION

Accordingly, the present invention is directed to a fray resistant wick and method for making a fray resistant wick that substantially obviates one or more of the problems associated with limitations and disadvantages of the prior art. The present invention is directed to a wick, and method for making same, that is fray resistant without necessitating use of a mechanical means for reducing fraying while at the same time maximizing the absorption along the outer walls of the wick.

Additional features and advantages of the invention will be set forth in the description which follows, and in part will be apparent from the description, or may be learned by practice of the invention. The objectives and other advantages of the invention will be realized and attained by the apparatus and methods particularly pointed out in the written description and claims hereof as well as the appended drawings.

To achieve these and other advantages and in accordance with the purpose of the invention, as embodied and broadly described, the invention includes an elongated fiber core, a web surrounding the core and a jacket surrounding the web, wherein the material of the web has either a lower melting point than the material of both the core and the jacket or is comprised of an adhesive and further wherein both the core and the jacket are fusibly or mechanically bonded to the web to form a integral structure.

In another aspect, the invention involves forming an elongated core of fiber material, surrounding the core with a web of material having either a lower melting point than the core material or being comprised of an adhesive, surrounding the web with a jacket of material having a higher melting point than the web material, and heating the core web and jacket to a temperature such that the core and jacket fusibly or mechanically bond to the web so as to form an integral wick structure.

In another aspect, the invention involves forming an elongated core of fiber material, surrounding the core with a web material having a lower melting point than the core material, the web material being in a molten state at the time of application. Then, while the web material is still molten, surrounding the web with a jacket material having a higher melting point than the web. As the web material cools, the jacket and core are fusibly bonded together so as to form an integral wick structure.

In another aspect, the invention involves forming an elongated core of fiber material, surrounding the core with a web of chemical adhesive in liquid state. Then, the web and core are surrounded by a jacket. The core, web and jacket assembly is then heated such that the solids of the adhesive web form a bond and create an integral wick structure.

It is to be understood that both the foregoing general description and the following detailed description are exemplary and are intended to provide further explanation of the invention as claimed.

BRIEF DESCRIPTION OF DRAWING

The accompanying drawings, which are incorporated in and constitute a part of this specification, illustrate embodiments of the invention and, together with the description, serve to explain the objects, advantages, and principles of the invention. In the drawings.

DETAILED DESCRIPTION OF THE PREFERRED EMBODIMENT

Figure 1A:
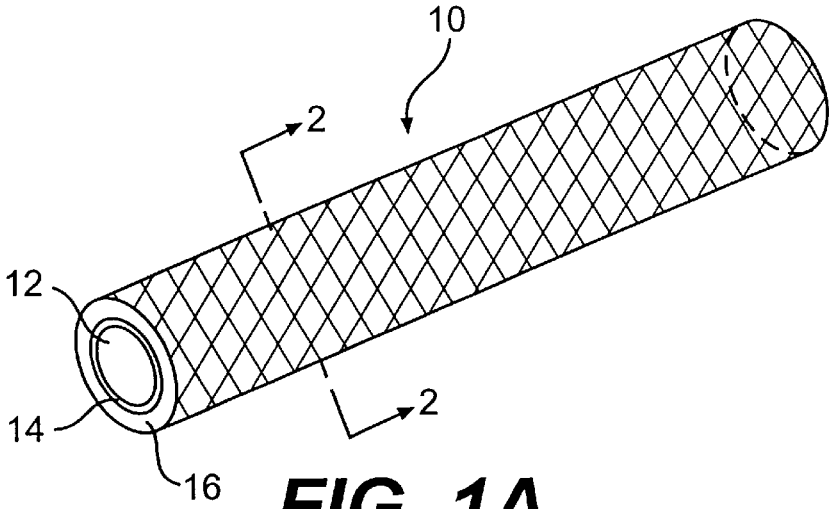
FIGS. 1A and 1B are perspective views of wicks in which the present invention is embodied.

Reference will now be made in detail to the present preferred embodiments of the invention, examples of which are illustrated in the accompanying drawings.

In accordance with the present invention, a fray-resistant wick is provided with an elongated fiber core, a web surrounding the core and jacket surrounding the web. According to the invention, the material of the web has either a lower melting point than the material on both the core and the jacket or is formed of a chemical adhesive and, moreover, the core and jacket are fusibly or chemically bonded to the web to form an integral structure.

The exemplary embodiment of the fray-resistant wick of the present invention is shown in FIG. 1 and is designated generally by reference numeral 10.

As embodied herein and as shown in FIG. 1A, the fray-resistant wick 10 includes an elongated fiber core of fiberglass 12 surrounded by a web of polypropylene yarn 14 with a fiberglass jacket 16 surrounding the web. The polypropylene yarn of the web 14 has a lower melting point than both the fiberglass of the core 12 and the jacket 16. After the wick 10 is assembled as shown in FIG. 1A, the wick is heated such that the polypropylene of the web 14 is fusibly bonded to the core 12 and the jacket 16 creating a fray-resistant wick 10.

In an alternate embodiment of the invention, the jacket may be an array of fiberglass and polypropylene yarns. Compositions containing texturized fiberglass made with class DE fiberglass filaments in the jacket and core produce good results.

Additionally, in the preferred embodiment, 70% of the wick cross sectional area is core fiber, 10% or less of the cross sectional area is fusible material and the remainder is jacket material.

As the wick is used to carry fuel from the fuel reservoir of the appliance to the combustion point, the preferred composition of fiberglass jacket and core are critical to the fuel burning appliance to maintain the longevity of the wick. These fibers are not affected by the heat produced by the combustion process, and thus the wicks do not burn, outlasting conventional cotton wicks.

Furthermore, a wick in which bothjacket and core yarn are able to freely carry liquid produces superior transfer capabilities over conventional non-fray constructions.

Figure 1B:
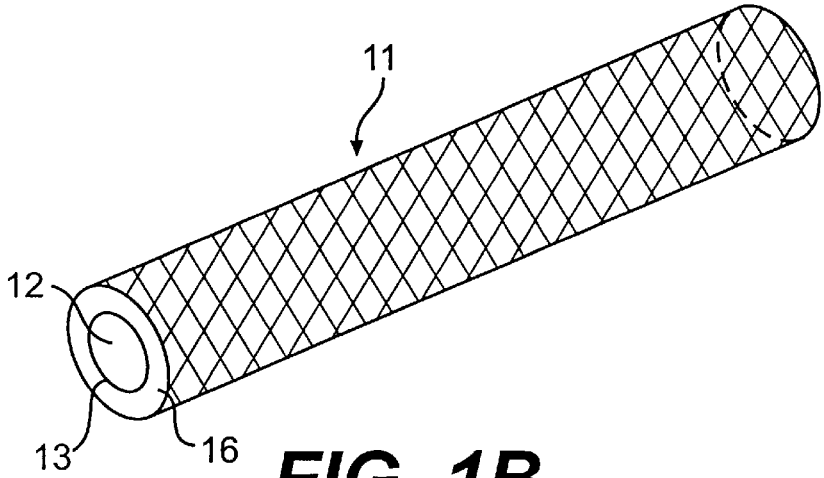
Figure 2:
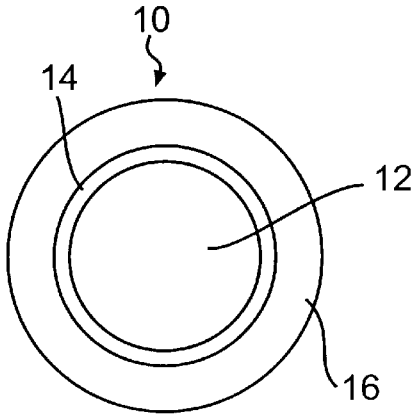
FIG. 2 is a cross-section on line 2—2 of FIG. 1A.

An alternate embodiment of the invention is shown in FIG. 1B. In this embodiment, a fray-resistant wick 11 includes an elongated fiber core 12 surrounded by a web of chemical adhesive 13 in liquid state with a fiberglass jacket 16 surrounding the web. After the wick 11 is assembled as shown in FIG. 1B, the wick is heated such that the solids of the adhesive web 13 form a bond with the core and the jacket to create an integral wick structure.

Another aspect of the invention is a method of manufacturing a fray-resistant wick. In accordance with this aspect of the invention, a fray-resistant wick is made by forming an elongated core of a fiber material and surrounding the core with a web of material having a lower melting point than the core material or which is able to chemically bond to the core and jacket material. Further, according to the invention, the web is then surrounded with a jacket of material having a higher melting point than the web material or being comprised of adhesive. Then, according to the invention, the combined core, web and jacket is heated such that the web fusibly or mechanically bonds to the core and jacket to form an integral wick structure.

In another aspect of the invention, the integral wick structure is cut into usable lengths.

Figure 3:
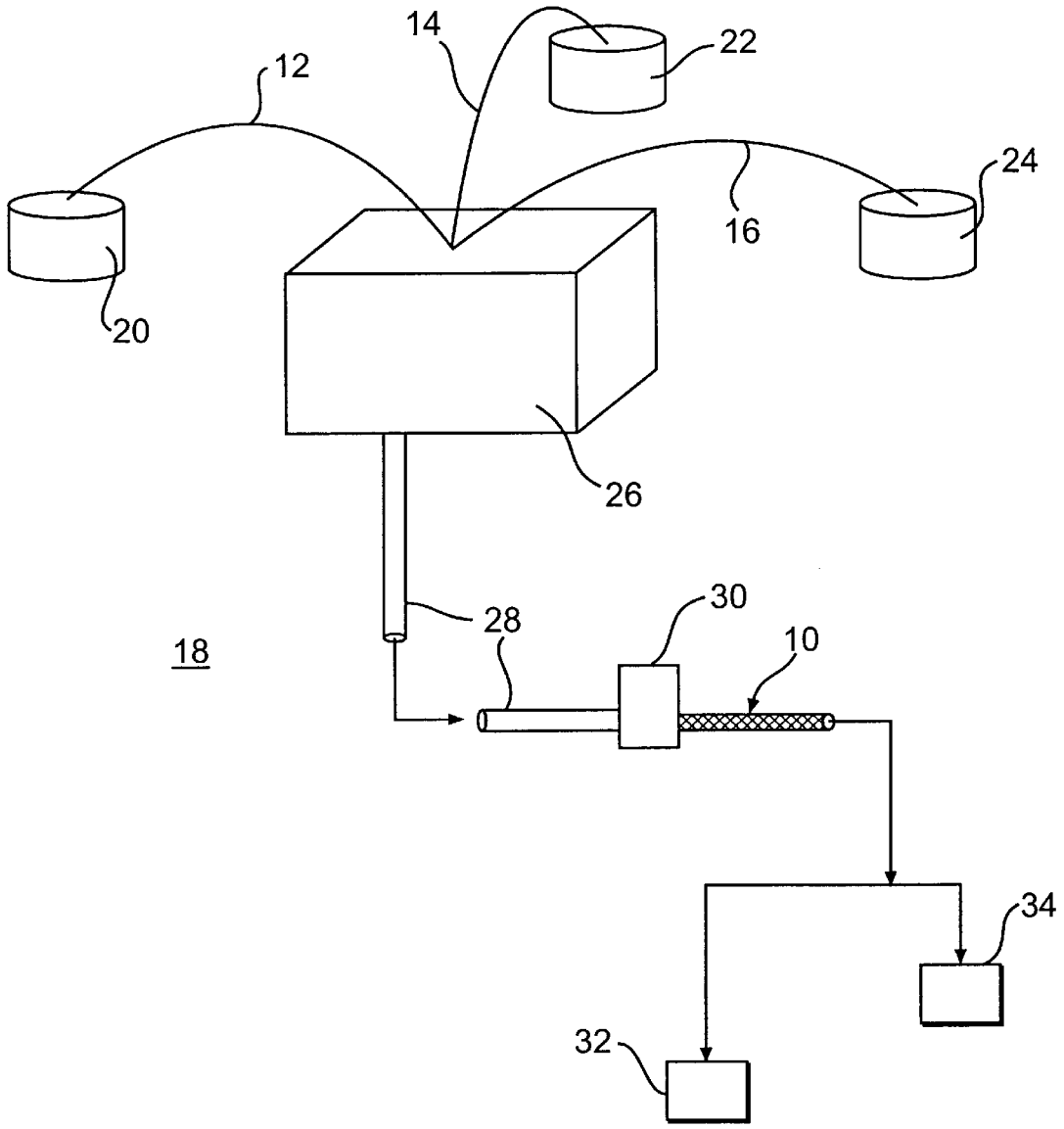
FIG. 3 is a block diagram of a system for manufacturing fray resistant wicks incorporating the present invention.

The exemplary embodiment of the method for manufacturing a fray-resistant wick 18 is illustrated in FIG. 3. A core of the fiberglass yarn 12, having been formed and stored at position 20, is fed into the wick forming apparatus 26 where it is surrounded by the polypropylene web 14, which is drawn from storage bin 22. The polypropylene 14 has a lower melting point than the fiberglass core 12.

The core and web material is then surrounded by a fiberglass jacket 16. The jacket material 16 is drawn from storage position 24. In an alternate embodiment, the jacket may consist of a knitted array of fiberglass and polypropylene yarns.

The incompleted wick 28 is drawn from the wick making apparatus 26 and fed into a heating means 30 wherein the core, web and jacket are heated to a temperature such that the core and jacket bond to the polypropylene web to form an integral wick structure 10. The integral wick structure 10 can then be fed into either a cutter 34 or a spooler 32. The cutter 34 cuts the integral wick structure 10 into usable lengths. The spooler 32 spools extended lengths of the integral wick structure 10 for storage and future use.

Preferably, the heater temperature is in the range of 154° C. to 164° C. Adequate cooling time must be provided before material is collected to avoid material adhering to itself in the take-up container.

Figure 4:
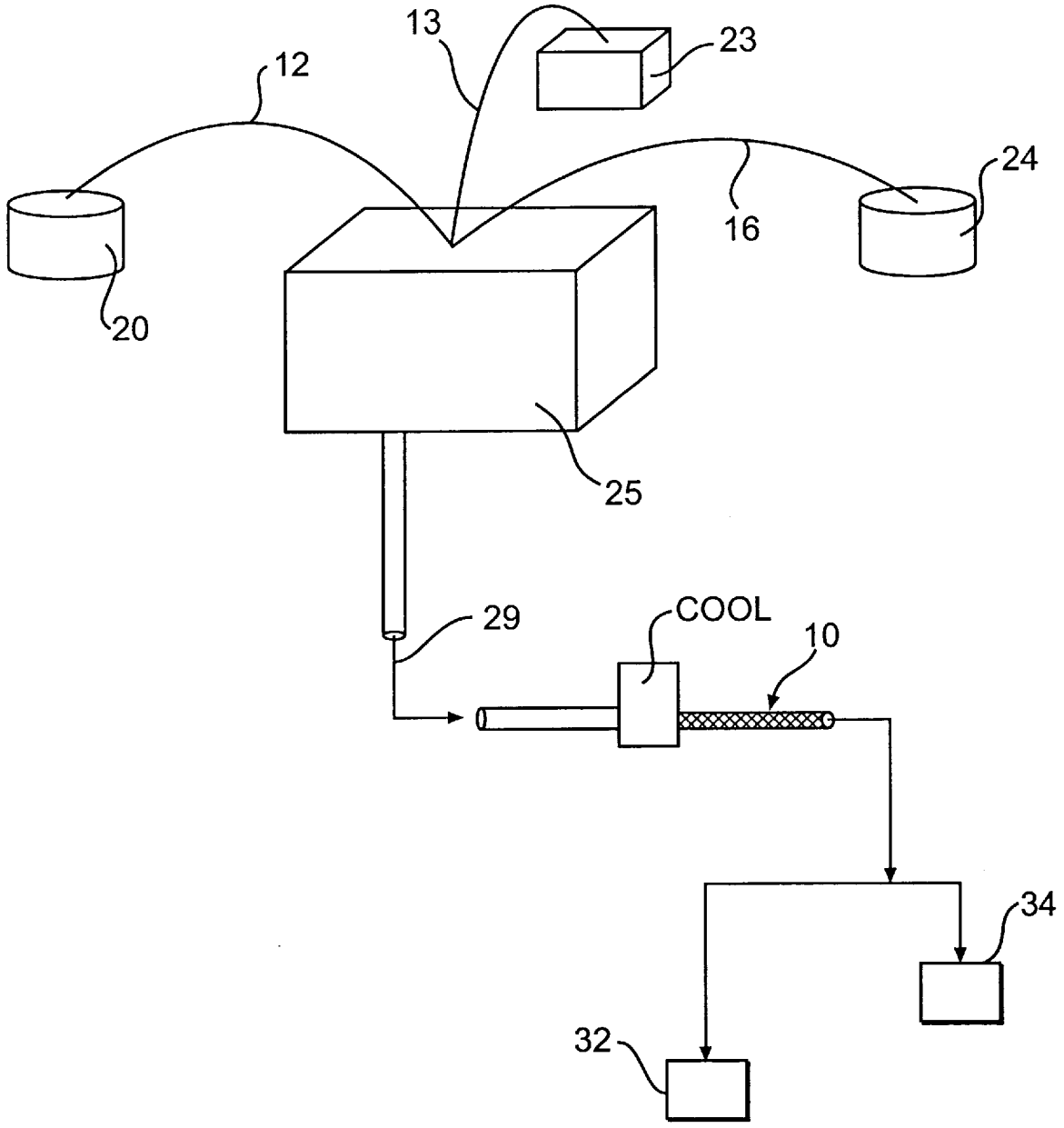
FIG. 4 is a block diagram of an alternate embodiment of a system for manufacturing fray resistant wicks incorporating the present invention.

In an alternate embodiment, the core is surrounded by a web material in a molten state with a lower melting point than the core material. The web is then surrounded by a jacket with a higher melting point than the web while the web is still molten. As the structure cools the core, web and jacket form an integral wick structure. This method is illustrated in FIG. 4. An elongated core of the fiberglass yarn 12 having been formed and stored at position 20 is fed into the wick forming apparatus 25 where it is surrounded by the molten polypropylene web 13 which is drawn from a reservoir 23. The reservoir 23 maintains the molten polypropylene at a preferred temperature for application, that is, 154° to 164° C. The polypropylene 13 has a lower melting point than the fiberglass core 12. The molten polypropylene may be applied to the core applied either in layer form or by atomizing the polypropylene and spraying onto the core. The core and molten web material is then surrounded by a fiberglass jacket 16. The jacket material 16 is drawn from storage position 24. In alternate embodiments, the jacket may be a knitted array of fiberglass and polypropylene yarns. The jacket material has a higher melting point than the molten web material.

The incomplete wick 29 is drawn from the wick making apparatus 25 and allowed to cool such that the core and jacket bond to the polypropylene web to form an integral wick structure 10. The integral wick structure 10 can then be fed into either a cutter 34 or a spooler 32. The cutter 34 cuts the integral wick structure 10 into usable lengths. The spooler 32 spools extended lengths of the integral wick structure 10 for storage and future use.

Figure 5:
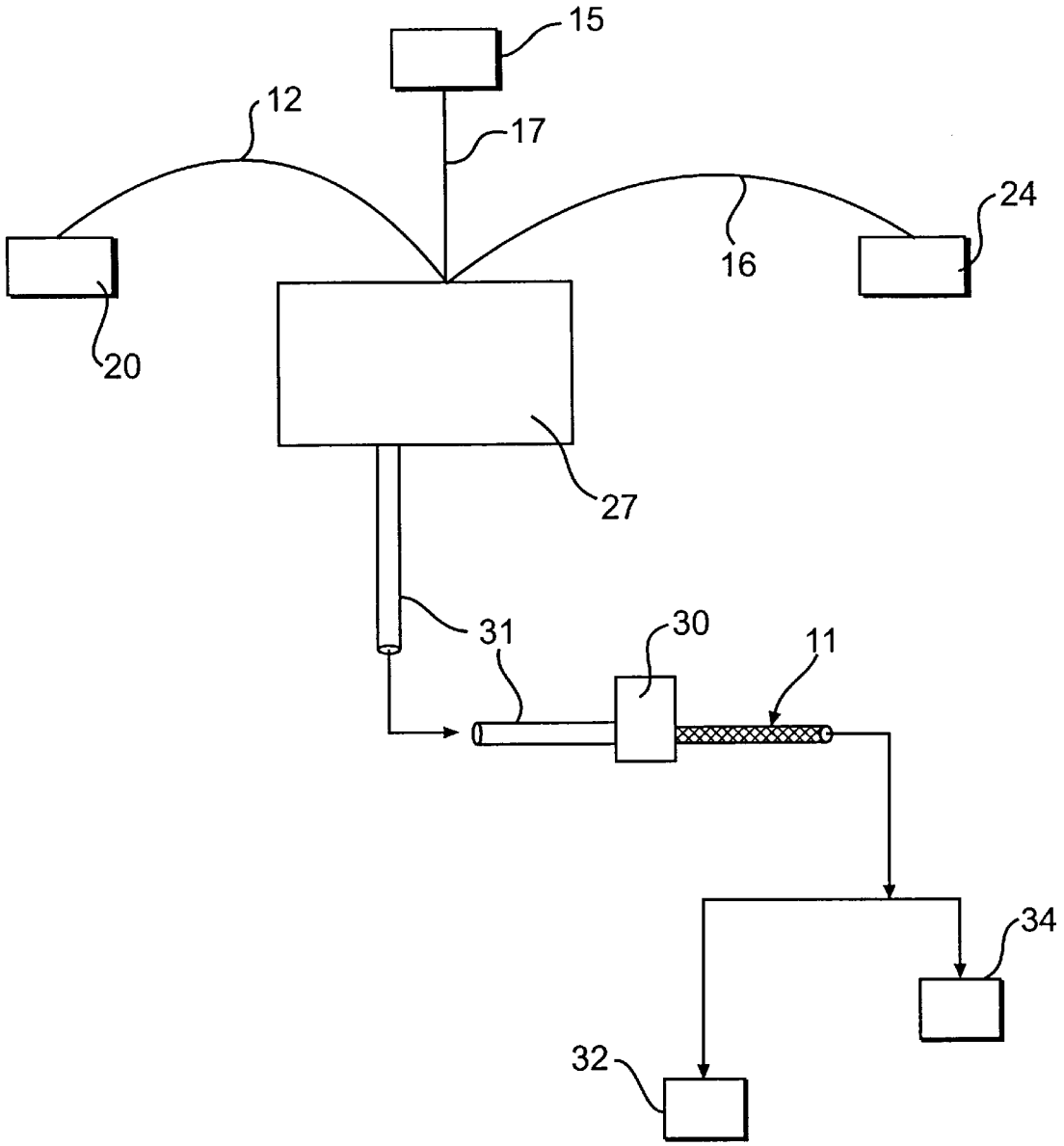
FIG. 5 is a block diagram of another alternate embodiment of a system for manufacturing fray resistant wicks incorporating the present invention.

In another alternative embodiment, the web is formed of an adhesive. The structure is then dried to create a bond between the core and web and between the web and jacket. The method is illustrated in FIG. 5. An elongated core of fiberglass yarn 12, having been formed and stored at position 20, is fed into the wick forming apparatus 27 where it is surrounded by liquid adhesive web 17, preferably white resin liquid adhesive, drawn from reservoir 15. The core and liquid adhesive web material is then surrounded by a fiberglass jacket 16. The jacket material 16 is drawn from storage position 24. In alternate embodiments, the jacket may be a knitted array of fiberglass and polypropylene yarns.

The incomplete wick 31 is drawn from the wick-making apparatus 27 and fed into a heating means 30 where the core, web and jacket are heated to a temperature such that the liquid adhesive dries to create a bond between the core and web and between the web and jacket to form an integral wick structure 11. The integral wick structure 11 can then be fed into either a cutter 34 or a spooler 32. The cutter 34 cuts the integral wick structure 11 into usable lengths. The spooler 32 spools extended lengths of the integral wick structure 11 for storage and future use.

It will be apparent to those skilled in the art that various modifications and variations can be made to the fray-resistant wick and method of manufacturing a fray resistant wick of the present invention without departing from the spirit of scope of the invention, thus it is intended that the present invention cover the modifications and variations of this invention provided they come within the scope of the appended claims and their equivalence.

We claim:

1. A fray-resistant wick comprising;

an elongated core of fiber material;

a web material surrounding said core; and a jacket material surrounding said web material, said web material having a lower melting point than both said core material and said jacket material, said core material and said jacket material being fusibly or adhesively or chemically bonded to said web material to form an integral structure.

2. A wick as claimed in claim 1, wherein said core material comprises fiberglass yarn.

3. The wick of claim 2 where said fiberglass comprises texturized fiberglass.

4. The wick of claim 2 where said fiberglass comprises texturized fiberglass made with class DE fiberglass filaments.

5. A wick as claimed in claim 1, wherein said web material comprises thermoplastic resin.

6. A wick as claimed in claim 5, wherein said thermoplastic resin comprises polypropylene yarns.

7. A wick as claimed in claim 1, wherein said jacket comprises nonflammable material.

8. A wick as claimed in claim 7, wherein said nonflammable material comprises fiberglass.

9. The wick of claim 8 where said fiberglass comprises texturized fiberglass.

10. The wick of claim 8 where said fiberglass comprises texturized fiberglass made with class DE fiberglass filaments.

11. A wick as claimed in claim 1, wherein said jacket comprises a knitted array of fiberglass and polypropylene yarns.

12. A fray-resistant wick comprising;

an elongated core of fiber material;

a web material surrounding said core; and a jacket material surrounding said web, wherein said web material is comprised of an adhesive and said core material and said jacket material are bonded to said web material to form an integral structure.

13. The material for making a fray-resistant wick as claimed in claim 12, further comprising the step of:

cutting the integral wick structure into useable lengths.

14. The method for making a fray-resistant wick as claimed in claim 12, wherein said step of heating the core, web and jacket is accomplished by an oven.

15. The method for making a fray-resistant wick as claimed in claim 12, wherein step of heating the core, web and jacket is accomplished at a temperature range of 154° to 164° C.

16. The method of claim 15 where said core or jacket comprise fiberglass yarns.

17. The method of claim 15 where said core or jacket comprise texturized fiberglass yarns.

18. The method of claim 15 where said core or jacket comprise texturized fiberglass made with Class DE fiberglass filaments.

19. Method for making a fray-resistant wick, said method comprising:

forming an elongated core of a fiber material;

surrounding said core with a web of material having a lower melting point than the core material;

surrounding said web with a jacket of material having a higher melting point than the web material; and heating the core, web and jacket to a temperature such that the core and jacket fusibly bond to the web so as to form an integral wick structure.

20. The method of claim 19 where said core or jacket comprise fiberglass yarns.

21. The method of claim 19 where said core or jacket comprise texturized fiberglass yarns.

22. The method of claim 19 where said core or jacket comprise texturized fiberglass made with Class DE fiberglass filaments.

23. Method for making a fray-resistant wick, said method comprising:

forming an elongated core of a fiber material;

surrounding said core with a web of molten material having a lower melting point than the core material;

surrounding said web with a jacket of material having a higher melting point than the web material; and allowing the molten web to cool such that the core and jacket are fusibly bonded to the web so as to form an integral wick structure.

24. The method of claim 23 where said core or jacket comprise fiberglass yarns.

25. The method of claim 23 where said core or jacket comprise texturized fiberglass yarns.

26. The method of claim 23 where said core or jacket comprise texturized fiberglass made with class DE fiberglass filaments.

27. Method for making a fray-resistant wick, said method comprising:

forming an elongated core of a fiber material;

surrounding said core with a web of liquid adhesive material;

surrounding said web of liquid adhesive material with a jacket of fiber material; and heating the core, web and jacket to a temperature such that the liquid adhesive dries and bonds the core, web and jacket so as to form an integral wick structure.

28. The method of claim 27 where said core or jacket comprise fiberglass yarns.

29. The method of claim 27 where said core or jacket comprise texturized fiberglass yarns.

30. The method of claim 27 where said core or jacket comprise texturized fiberglass made with class DE fiberglass filaments.

* * * * *